US005705306A

United States Patent [19]

Kitani et al.

[11] Patent Number: 5,705,306

[45] Date of Patent: Jan. 6, 1998

[54] TONER FOR FORMING ELECTROPHOTOGRAPHIC IMAGE AND DEVELOPERS USING THE SAME

[75] Inventors: Ryuji Kitani; Meizo Shirose; Tatsuya Nagase; Keiko Ujihara; Michiaki Ishikawa, all of Hachioji, Japan

[73] Assignee: Konica Corporation, Japan

[21] Appl. No.: 645,126

[22] Filed: May 13, 1996

[30] Foreign Application Priority Data

May 17, 1995 [JP] Japan ..... 7-118255
Jun. 20, 1995 [JP] Japan ..... 7-153220

[51] Int. Cl.[6] ..... G03G 9/097

[52] U.S. Cl. ..... 430/110; 430/111

[58] Field of Search ..... 430/109, 111, 430/137, 110

[56] References Cited

U.S. PATENT DOCUMENTS 5,080,992 1/1992 Mori et al. ..... 430/109

5,538,830 7/1996 Swidler ..... 430/115

*Primary Examiner*—John Goodrow

*Attorney, Agent, or Firm*—Jordan B. Bierman; Bierman, Muserlian and Lucas LLP

[57] ABSTRACT

A toner for forming an electrophotographic image is disclosed. The toner comprises (1) colored particles comprising a resin and a colorant, (2) fine resin particles comprising a polymer formed by condensation of melamine and formaldehyde, and have a volume average diameter of 0.01 μm to 1.0 μm, and (3) fine particles of an inorganic material (I) having a volume average diameter of 0.01 μm to 0.20 μm and a standard deviation of distribution of the volume average diameter G satisfying the condition of $10 \leqq \sigma \leqq 30$. It is particularly preferred that the toner is used as a tow componet developer together with a negatively chargeable carrier which comprises (1) magnetic core particles each coated with a coating layer comprising a mixture of homopolymer of an alicyclic methacrylate monomer and a homopolymer of an acyclic methacrylate monomer, or a copolymer of an alicyclic methacrylate monomer and an acyclic methacrylate monomer, and (2) a fine particles of an inorganic material (II).

25 Claims, No Drawings

TONER FOR FORMING ELECTROPHOTOGRAPHIC IMAGE AND DEVELOPERS USING THE SAME

FIELD OF THE INVENTION

This invention relates to a toner for forming an electrophotographic image and a developer using the toner.

BACKGROUND OF THE INVENTION

As the technology for forming a polychromatic image by means of a compact and low cost polychrome image forming apparatus, a method carried out by the following procedure is known: (1) forming a static latent image on the surface of an image forming photoreceptor by imagewise exposing the surface of the photoreceptor uniformly charged to a spot of light from a light source such as a laser beam, (2) developing the static latent image by a two-component developer containing a color toner by a non-contact developing method, (3) repeating the exposure and developing steps with respect to the other color image to form a pile of plural toner images each having different colors on the surface of the photoreceptor, and (4) collectively transferring the plural toner images to a image receiving sheet and fixing the images to form a polychrome picture.

However, the following problems are caused in the above-mentioned technology. In the above-mentioned method, a non-contact development is required to develop the static latent image since the plural images to be formed on the same area of the photoreceptor in a piled form. In the non-contact developing method, there is a problem that a slight variation in the triboelectric charged of toner particles largely influences to the development result because the space between the surface of the photoreceptor and the surface of a developer carrying member of a developing device should be make wider in the developing zone. The variation in the triboelectric charge of the toner particles cause a variation in the amount of toner particle in the developed image. Generally, the charge of toner particles is varied with the lapse of time. As a result of that, the amount of each colored toners are varied in the piled toner images so the color tone of thus formed polychrome picture is varied according to repeating of the image forming operation.

Accordingly, it is required to maintain the triboelectric charge of the toner particles within a prescribed range. For satisfying such requirement, it has been proposed to externally add fine particles of an inorganic material and fine particles of organic resin to the toner particles for stabilizing the triboelectric charge of toner particles.

However, in a system in which inorganic fine particles are only added to a toner, the triboelectric charge of the toner particles is easily lowered under a high-temperature and high-humidity condition by leak of the charge caused by absorption of water to the toner particles. The lowering in the triboelectric charge causes raising in the image density and contamination in an image forming apparatus by scattering of the toner particles. On the other hand, in a system in which fine particles of organic resin are only added to a toner, an excessive triboelectric charge is caused under a low-temperature and low-humidity condition, even though the lowering in the charge amount of the toner particles under the high-temperature and high-humidity condition can be inhibited by a high charge holding ability of the resin fine particles. Accordingly a problem of excessive triboelectric charge of toner is raised in the course of repeated image forming operation.

Moreover, in a system comprised of toner particles, fine resin particles and fine inorganic particles, the absolute difference between the charge amount under a high-temperature and high-humidity condition and that under a low-temperature and low-humidity condition is become larger when polyacrylate resin particles disclosed in Japanese Examined Patent Publication (JP) 2-60179/1990 are used even though the triboelectric charge amount of the toner particles is stabilized to a certain extent. Accordingly, the image density cannot be stably maintained with respect to the variation of the environmental condition.

Further, it has been found by the inventor in the course of the present invention that the inorganic particles are apt to be buried into the toner particle under a non-contact developing condition when the inorganic fine particles have a narrow particle size distribution. Particularly, decreasing of the charge amount caused by burying of the inorganic particles is considerably accelerated when the volume average size of the inorganic particle is 0.03 μm or less and have narrow size distribution. On the other hand, when inorganic particles have a volume average size of not less than 0.1 μm and a narrow size distribution is narrow, the particles of inorganic particles are difficulty adhered on the toner particles and a toner having an uniform composition hardly be obtained. As a result of that, the triboelectric charge of the toner cannot be stabilized.

Within the range of 0.03 μm to 0.1 μm of the average size of the inorganic particles, fluidity donating effect and burying preventing effect of the particles cannot be compatibly obtained when the size distribution of the particles is too narrow, even though the burying and releasing of the particles are mitigated.

Developer for electrophotographic image includes a one-component developer and a two component developer. The two-component developer is composed of non-magnetic toner particles and magnetic carrier. The two-component developer is preferably used in the reason of that a satisfactory triboelectric charge can be given by mechanical stirring. The magnetic carrier is required to have an adequate ability of frictional electrification, fluidity, developing property and a high durability fitting for use for a prolonged term. Further, it is required to not give any damage to the photoreceptor surface at the time of contact developing or cleaning thereof.

Then Japanese Patent Publication Open for Public Inspections (JP O.P.I.) 59-104664/1984 and 63-37360/1988 propose each a carrier coated with an alicyclic methacrylate homopolymer and that coated with an aliphatic methacrylate homopolymer, respectively. These publication describe that the triboelectrification property and fluidity of carrier are made excellent and water absorption of carrier is inhibited by the above-mentioned resin coating.

Recently, kinds and amounts of external addenda in the toner are increased, accompanied with decreasing in the toner particle size. The external addenda for toner are made hydrophobic to prevent change of the electrification order caused by water absorption under a high-humidity condition and to decrease the fluctuation of the charge amount depending on the environmental conditions. In the actual situation, however, the toner absorbs water more easily than the carrier because the hydrophobilization of the external addenda of the toner is insufficient, and the fluctuation of charge amount depending on the environmental conditions is still remained. Accordingly, excessive the hydrophobilization of the carrier makes larger the fluctuation of the charge amount depending on the environmental conditions.

The method for coating the carrier particles can be broadly divided into two methods. One of them is a solution coating method including a spray coating method in which a solution prepared by dissolving a resin for coating in a solvent is sprayed to carrier particles in a state of fluidized layer and dried, an immersion coating method in which the carrier particles are immersed in a resin solution prepared by dissolving a resin for coating in a solvent and dried, and a sintering coating method in which magnetic particles is previously coated with a solution of a resin and sintered to make the carrier particles. Another method includes a dry coating method in which a coating resin is adhered and fixed on the surface of carrier particle by mechanical impact as described in JP O.P.I. Nos. 2-8860/1990 and 3-144579/1991. The carrier made by the dry coating method is generally used.

On the other hand, it is necessary for realizing the non-contact development to make the thickness of the layer of a developer as thinner as possible, so that the developing gap to be made not more than 1 mm. A developer layer having a uniform thickness should be stably formed for carrying out the non-contact development under such condition.

A thin developer layer forming method proposed in JP O.P.I. No. 2-50148/1990 using a rod-shaped hard magnetic member is effective to form a thin developer layer having a stable layer thickness. This method has the following drawbacks even though the method has a merit that a thin developer layer can be stably formed thereby.

(1) The developer is received a strong stress and the stress is made serious by decreasing the amount of developer accompanied with small-sizing of the developing device. The increasing of stress causes destroying or peeling off of the coating layer of the carrier particle and gives bad influence on the durability of the developer. (2) The amount of the developer taken out and transported by the developing device is varied accompanied with a variation of the filling density of the developer particles in the developer layer caused by changing of the environmental condition. The variation in the transporting amount of the developer causes a variation in the developer layer thickness and influences to the developing result because the layer thickness is thin.

In the developing method using a thin developer layer, the coating layer of the carrier is apt to be worn or to be peeled off from the core particle of the carrier because the carrier particles receive a large stress in such the developing method as above-mentioned. Hydrophobilized silica particles are added to the coating layer of the carrier particles for solving these problems as is shown in JP O.P.I. No. 59-232362/1984. However, the effect of the addition of the hydrophobic silica is not sufficient even though the silica is effective to some degree.

SUMMARY OF THE INVENTION

An object of the invention is to provide a toner for forming an electrophotographic image by a non-contact developing method, which is able to stably maintain triboelectric charge of the toner for a prolonged term and under various environmental conditions when the toner is applied for a non-contact developing method.

Another object of the invention is to provide a developer for developing an electrophotographic image which is able to maintain a stable triboelectrification ability for a prolonged term without any influence of environmental conditions when the developer is used in a polychrome image forming method in which plural toner images are piled up on the surface of a photoreceptor and the piled up images are collectively transferred to a image receiving member.

The objects of the invention can be attained by a toner for forming an electrophotographic image comprising (1) colored particles comprising a resin and a colorant, (2) fine resin particles comprising a polymer formed by condensation of melamine and formaldehyde, and have a volume average diameter of 0.01 μm to 1.0 μm, and (3) fine particles of an inorganic material (I) having a volume average diameter of 0.01 μm to 0.20 μm and a standard deviation of distribution of the volume average diameter σ satisfying the condition of $10 \leqq \sigma \leqq 30$.

It is particularly preferred that the above-mentioned toner is used as an electrophotographic developer together with the following carrier in combination.

The carrier is a negatively chargeable carrier comprising magnetic core particles each coated with a coating layer comprising (1) a mixture of homopolymer of an alicyclic methacrylate monomer and a homopolymer of an acyclic methacrylate monomer, or a copolymer of an alicyclic methacrylate monomer and an acyclic methacrylate monomer, and (2) a fine particles of an inorganic material (II).

DETAILED DESCRIPTION OF THE INVENTION

In the toner for forming electrophotographic image forming of the invention, hereinafter simply referred to toner, lowering in the triboelectric charge under a high-temperature and a high-humidity condition and excessively raising in the triboelectric charge under a low-temperature and a low-humidity condition are inhibited by adding particles of an inorganic material (I), so that the stability of charge amount under various conditions can be obtained. Hereinafter, "triboelectric charge" and "particle of an inorganic material (I)" are each simply referred to "charge" and "inorganic fine particle", respectively.

Further, the excessive charge under a low-temperature and a low-humidity is inhibited and the specific charge maintaining ability of organic particles can be held by the use of melamine-formaldehyde condensation polymer as the resin fine particles. As a result of that, stable charging of the toner can be realized without influence of the environment condition.

In the present invention, the volume average diameter of the resin fine particle is within the range of 0.01 to 1.00 μm, preferably 0.05 to 0.50 μm. When the volume average diameter is less than 0.01 μm, the particles are apt to be easily buried in the colored particle and the stability of charge ability of the toner is lowered. On the other hand, when the volume average diameter is more than 1.0 μm, the resin fine particles are difficult to uniformly adhere on the colored particle. As the result of that, distribution of the charge in the toner particles is made broader and defects of image such as toner scattering tend to occurred. The adding amount of the resin fine particles is preferably 0.1 to 5.0% by weight, more preferably 1.0 to 3.5% by weight of the total weight of the toner. When the amount is too small, charge lowering in a high-temperature and a high-humidity condition is increased, and when the amount is too large, charge raising under a low-temperature and a low-humidity condition is observed.

In the present invention, a stable charge ability of toner can be obtained by the use of inorganic fine particles (I) having the specific size distribution, since burying of external addenda into the colored particles can be inhibited by the use of inorganic fine particles (I) having such size distribution. It has been found by the inventors that of the volume size distribution of the inorganic fine particles to be added to the toner is considerably influences to the stability of charge of the toner. When the inorganic fine particles (I) having the size distribution specified in the invention are used, a good fluidity is given to the toner by the particles included in the smaller size portion of the size distribution. On the other hand, the particles included in the larger size portion of the size distribution are effective to alleviating stress given to the smaller particles as well as effective to inhibiting the burying of the inorganic fine particles in to the colored particle. Accordingly, the term for burying the inorganic fine powder into the colored particles is considerably prolonged and the charge of the toner is stably maintained for a prolonged period.

It is preferred that the inorganic fine particles (I) to be added to the toner to each has the same composition. In the present invention the inorganic fine particles (I) have a wide size distribution. Therefore, when the inorganic fine particles (I) have the same composition, the triboelectric charge amount to be given to the toner is kept within a little variation range even when the smaller inorganic particles is become to contribute to the charge ability of the toner after the larger inorganic particles have been buried into the colored particles since the composition of the larger particles and that of the smaller particles are the same.

The volume average diameter of the inorganic fine particles (I) to be used in the toner of the invention is within the range of 0.01 to 0.20 μm, preferably 0.03 to 0.15 μm. When the volume average diameter of the particles is less than 0.01 μm, the inorganic particles tend to easily be buried into the colored particles and the charge ability of the toner is cannot be stably maintained in a prolonged term. On the other hand, when the volume average diameter of the particles is more than 0.20 μm, image defects such as toner scattering is apt to be caused since the particles cannot be uniformly adhered to the colored particles and the distribution of charge is made broader. The volume average diameter of the particles in the invention is obtained by image analysis of the transmission electronmicroscopic image of the particles.

The adding amount of the inorganic fine particles is preferably 0.1 to 5.0% by weight, more preferably 2.0 to 3.5% by weight, of the total weight of the toner. When the adding amount is too small, the charge is lowered by rapidly burying of the external addenda. When the adding amount is too large, the charge lowering under a high-temperature and high-humidity condition is become considerable.

The standard deviation of the volume diameter distribution represented by σ of the inorganic fine particles (I) of the invention is 10 to 30, preferably 10 to 25. When the σ value is less than 10, i.e., diameter distribution is too narrow, and the volume average diameter is small, for instance not more than 0.1 μm, burying of the external addenda tends to be accelerated. When the diameter distribution is narrow as the above and the volume average diameter is larger, for instant more than 0.1 μm, a large amount of addition is required to obtained a sufficient fluidity of the toner and a sufficient inhibiting effect for burying of the external addenda even though the burying of the inorganic particles is inhibited. The addition of the large amount of the inorganic particles causes formation of free inorganic particles which are not adhered to the colored particle, which causes broadening of the distribution of the charge of the toner particles resulting a image defect such as toner scattering. Contrary to that, when the value of σ is exceed to 30, the distribution of the volume diameter is excessively wider and the distribution of the charge is broadened so an image defect such as toner scattering is occurred. The inorganic particles having the above-mentioned σ value can be obtained by classification of the particles or mixing two or more kinds of particles each having a different particle size.

It is preferred that the inorganic particle of the invention is not influenced by water adsorbed thereon. Therefore, as the inorganic fine particles (I) to be used in the toner of the invention, hydrophobic ones are preferably used. As an indicator of the hydrophobicity of the particles, a value determined by the following methanol wettability measuring method. A higher value of the result of this method corresponds to a high hydrophobicity of the particles. The inorganic fine particles (I) preferably have a hydrophobicity of 20 to 99, more preferably 40 to 95, particularly 60 to 95.

To 50 ml of distilled water in a beaker of 250 ml, 0.2 g of inorganic particles to be measured is put and methanol is gradually added from a bullet, the end of which is immersed in the water, with slow stirring. The volume of methanol necessary for completely wetting the particles, a ml, is measured. The hydrophobicity of the particles in terms of methanol wettability is calculated by the following equation:

$$\text{Hydrophobicity}=\{a/(a+50)\}\times 100.$$

The adding ratio by weight of the resin fine particles to the inorganic fine particles (I) is preferably within the range of 0.1 to 3.0, more preferably 0.2 to 2.0. When the ratio is smaller than 0.1, the effect of the resin particles is become insufficient and the charge is lowered under a high-humidity condition. When the ratio is larger than 3.0, the effect of the inorganic particles is decreased and the charge amount is excessively raised under a low-humidity condition.

Further, it is preferred to fix the external addenda such as resin fine particles and the inorganic fine particles (I) on the colored particle. The fixation of the external addenda on the colored particle inhibits transfer of the external addenda to carrier particles, and the contamination of the carrier particles with the external addenda can be avoided. So the charge amount of the toner is stably maintained and good images can be stably obtained for a prolonged term.

The degree of the fixing of the external addenda on the colored particles is evaluated by a single point BET single point specific surface area in $m^2/g$ measuring method and fixing degree Fd is defined as follows:

$$Fd=[1-(Sw_1-Sw_2)/(Sw_3)]\times 100.$$

In the above,

Fd: Fixing degree (%)

$Sw_1$: BET specific surface area of colored particles on which external addenda particles are fixed.

$Sw_2$: BET specific surface area of colored particles without any external addenda particle $Sw_3$: BET specific surface area of external addenda particles added to the colored particles.

The BET specific surface area can be measured by BET one point method using a BET specific surface area measuring apparatus such as Flowsorb 2300 manufactured by Shimazu Seisaksyo Co., Ltd.

A method in which the colored particles and the particles of external addenda are stirred and mixed under a temperature within the range of Tg±20° C., is preferred for fixing the particles of external addenda onto the surface of the colored particles. In the above method, the particles of the addenda are fixed on the surface of the colored particles by mechanical impact given during the stirring.

In the above, Tg is the glass transition temperature of the colored particles or a binder resin of the colored particles. The glass transition temperature can be measured by a differential scanning calorimeter such as DSC7 manufactured by Perkin-Elmer Co., Ltd., according to the following procedure. A sample is once heated from 0° C. to 200° C. in a rate of 10° C./min. and then cooled from 200° C. to 0° C. in a rate of 10° C./min. to erase the thermal hysteresis of the sample. Then the sample is heated 0° C. to 200° C. in a rate of 10° C./min. to obtain a thermogram and the glass transition temperature Tg is determine by the temperature at which the thermogram shows a peak. When plural peaks are observed, the temperature of the principal peak is defined as the glass transition temperature Tg of the sample.

Tg of the colored particle or binder resin is preferably 40° to 70° C. The toner composed of colored particles having a Tg less than 40° C. is inferior in the storage ability, which tends to coagulate. Toner having a Tg higher than 70° C. is not preferable from the view point of fixing property and product ability of the toner.

For fixing the external addenda particles on the surface of the colored particles, a mixer such as Henschel mixer, Loedige mixer and Turbo Sphere mixer can be used. Among them, Henschel mixer is suitably used in the reason of that the step of mixing the colored particle and the external addenda particles and the step of fixing the addenda particles on the colored particle can be performed by the same mixing device and the mixture is easily stirred and heated in the device.

In the treatment for fixing the addenda particles on the colored particle, the mixture is preferably stirred by a stirrer blade with a circumferential speed of 10 to 40 m/sec. It is preferred that the colored particles and the external addenda is previously mixed before the fixing treatment. The temperature of the mixture is preferably controlled at an adequate temperature by externally heating with a heating medium such as hot water circulating in a jacket of the mixing device. The temperature of the fixing treatment is measured at the portion at which the mixture is flown by stirring. The colored particles are preferably cooled by cold water circulating in the jacket and crushed.

Plural kinds of fine particles are fixed on the colored particles simultaneously or separately by the above-mentioned method. An addendum such as a fluidity giving agent may be added to the toner after the fixing treatment.

Constituents of the toner of the invention are described below.

Colored particles

The color particle of the toner of the invention comprises a binder resin, colorant and another addendum according to necessity. The size of the particle is ordinary within the range of 1 to 30 μm, preferably 5 to 20 μm, in terms of volume average diameter.

As the binder resin for the colored particles, well known various kinds of resins can be used without any limitation. For example, a styrene resin, an acryl resin, a styrene/acryl resins and a polyester resin are usable. It is preferred that the resins have a Tg of 40° to 70° C.

Various kinds of colorants can be used in the colored particle of the invention without any limitation. For example, carbon black and Nigrosine dyes for black toner, and C.I. Pigment Blue 15:3, C.I. Pigment Blue 15, C.I. Pigment Blue 15:6, C.I. Pigment Blue 68, C.I. Pigment Red 48-3, C.I. Pigment Red 122, C.I. Pigment Red 212, C.I. Pigment Red 57-1, C.I. Pigment Yellow 17, C.I. Pigment Yellow 81 and C.I. Pigment Yellow 145 for cyan, magenta or yellow toner are preferably usable.

Further, charge controlling agent such as a salicylic acid derivative or a metal complex of diazo compound and a fixing ability improving agent such as a low molecular polyolefin or carnauba wax may be used.

External addenda

<Resin fine particle>

Fine resin particles to be used in the toner of the invention have a volume average diameter of 0.01 to 1.00 μm. The volume average diameter is observed by a transmission-type electron microscope and is determined by image analysis. The material composing the resin particle is a condensation product of melamine and formaldehyde, and the shape of the particle is substantially sphere.

The "substantial sphere" means that the ratio of the length of longer axis to that of shorter axis of the particle, i.e. sphericity, determined by an image analyzing apparatus is less than 0.8.

<Inorganic fine particle (I)>

The inorganic fine particles (I) to be used in the toner of the invention have a volume average diameter of 0.01 to 0.20 μm. The volume average diameter is observed by a transmission-type electron microscope and determined by image analysis. The standard deviation σ of the particle size distribution is obtained by the following equation using the data determined with respect to each of the particles.

$$\sigma=[\{\Sigma(\chi_i-\chi)^2\}/n]^{1/2}$$

in the above $\chi_i$: Diameter of the sampled individual particles $\chi$: volume average diameter n : Number of sampled particles As the material composing the fine inorganic particles (I), various kinds of inorganic compounds such as an oxide, a nitride and a boride are preferably usable. For example, silica, alumina, titania, zirconia, barium titanate, aluminum titanate, strontium titanate, magnesium titanate, zinc oxide, chromium oxide, cerium oxide, antimony oxide, tungsten oxide, tin oxide, tellurium oxide, manganese oxide, boron oxide, silicon carbide, boron carbide, titanium carbide and boron carbide are described. Fine particles of the above-mentioned inorganic compounds may preferably be subjected to a hydrophobilizing treatment. It is preferred that the hydrophobilizing treatment is carried out by the use of a silane coupling agent such as dimethylchlorosilane, hexamethyldisilazane. The hydrophobic treatment by a metal salt of higher fatty acid such as aluminum stearate, zinc stearate or calcium stearate is also preferred.

The above-mentioned toner of the invention is preferably used in a form of two-component developer together with a magnetic carrier particles. As the carrier, that made of iron powder, ferrite. magnetite and those with resin coated are usable. A carrier having a low magnetization, low density and small size is preferred from the view point of uniformity of magnetic brush and resistivity for stress.

As the core particle of the carrier, one having a specific gravity of 3 to 7 and a volume average diameter of 30 to 65 μm. Ferrite particles or magnetite particles satisfying the above conditions are preferably usable.

A styrene resin, acryl resin and styrene-acryl resin are preferably used for coating the core particle of the carrier.

In the particularly preferable embodiment of the present invention, the toner particles is used together with a negatively chargeable carrier which comprises a magnetic particle coated with a coating layer comprising a mixture of a homopolymer of alicyclic methacrylate and a homopolymer of acyclic methacrylate or a copolymer of alicyclic methacrylate and acyclic methacrylate, and a fine particle of inorganic compound, herein after referred to inorganic fine particles (II).

The above-mentioned magnetic carrier specifically usable with the toner of the invention is described below.

<Core particle>

Iron, ferrite, magnetite, an alloy or compound containing iron, nickel, cobalt, copper are usable as the core particle of the carrier. Among them one having a specific gravity of 3 to 7 is preferred since stress given to the developer at the time of stirring in a developing device is alleviated when such a carrier is used.

It is preferred that the saturated magnetization and the volume average particle diameter of the core particle are 15 to 80 emu/g and 20 to 100 μm, respectively.

The resin for coating the core particle is a copolymer of an alicyclic methacrylate monomer and a acyclic methacrylate monomer in a ratio of 1:9 to 9:1, more preferably 3:7 to 7:3. The copolymer may contains another resin in a ratio of not less than 50% by weight. The copolymer may be one formed by copolymerization of the alicyclic methacrylate monomer, acyclic methacrylate monomer and a styrene-type monomer such as styrene, α-styrene or parachlorostyrene. In such the case, the ratio of the styrene-type monomer to the alicyclic and acyclic methacrylate monomers is less than 50 mol %.

The alicyclic methacrylate monomer is preferably one having a cycloalkyl ring having 3 to 7 carbon atoms such as cyclopropyl methacrylate, cyclopentyl methacrylate, cyclohexyl methacrylate or cycloheptyl methacrylate. Among them cyclohexyl methacrylate having a cycloalkyl ring with 6 carbon atoms is particularly preferred from the view point of the effect refreshing the surface of the carrier particle.

As the acyclic methacrylate monomer to be copolymerized with the alicyclic methacrylate, for example, methyl methacrylate, ethyl methacrylate, propyl methacrylate, n-butyl methacrylate, hexyl methacrylate, octyl methacrylate and 2-ethylhexyl methacrylate are described. From the view point of the refreshing the surface of the carrier particle, a methacrylate of acyclic group having 1 to 6 carbon atoms is preferred.

As the coating resin of the carrier, a mixture of a homopolymer of an alicyclic methacrylate monomer and a homopolymer of an acyclic methacrylate monomer in a ratio of 1:9 to 9:1, preferably 3:7 to 7:3. The mixture of the polymers may further contains another resin in a ratio of not less than 50% by weight.

The resin for forming a resin coating layer of the coated carrier particle may contain a resin other than the resin or resins specified in the invention in a weight ratio of less than 50%. As the resin other than specified resin, for example, styrene resins, acryl resins, styrene-acryl resins, vinyl resins, ethylene resins, rosin modified resins, polyester resins and a silicone resins are usable. These resins may be used in combination.

The total amount of the resins coated on the magnetic core particles is preferably 0.5 to 5.5% by weight, more preferably 1.0 to 4.0% by weight, of the core particles. The coating amount of less than 0.5% causes exposure of the surface of the magnetic core particle, and the coating amount exceeding 5.5% causes lowering adhering force between the surface of the core particle and the coating layer so the coating layer tends to peel off from the particle surface.

<Inorganic fine particle>

Although there is no limitation on the martial of the inorganic particle, silica, alumina and magnesia are usable. It is preferred that the inorganic fine particle has a small hydrophobicity determined by the foregoing methanol wettability measuring method.

Among them, hydrophilic silica having a hydrophobicity of less than 20 is preferred since the hydrophilic silica is excellent in water absorbing ability and improves the dispersibility in the coating material. Particles of magnesium compound such as magnesium oxide, magnesium carbonate, magnesium hydroxide or these magnesium compound particles given a hydrophilizing treatment on the surface thereof are also preferred since they have an effect of improving the charge raise up property. It is preferred that the inorganic fine particles to have a volume average diameter of 0.001 μm to 0.2 μm and a BET specific surface area of 10 to 500 $m^2/g$. The particles having a volume average diameter of 0.005 μm to 0.1 μm and a BET specific surface area of 20 to 200 $m^2/g$ are particularly preferred from the view point of the dispersibility of the particles. Particles having a volume average diameter of less than 1 nm and a BET specific surface area of more than 500 $m^2/g$ are apt to be easily buried into the core particles. On the other hand, particles having a volume average diameter of more than 200 nm and BET specific surface area of less than 10 $m^2/g$ tend to difficult to be dispersed in the coating layer and free particles are easily formed, the free particles hinder the electrification of the toner particle. The average diameter of the inorganic particle is a volume average diameter of primary particles measured by a transmission type electron microscope LPA-3000/3100 manufactured by Otsuka Densi Co., Ltd. The BET specific surface area is a value measured by single point method by a BET specific surface area measuring apparatus such as Flow Sorb II2300, manufactured by Shimazu Seisaku-sho. Inorganic fine particles having a resistivity of $10^6$ to $10^{10}$ Ω.cm are preferred. The resistivity of the particles is a value measured with respect to a sample in a state of powder under a prescribed pressure. The above-mentioned value is an intrinsic volume resistivity under a condition of a temperature of 20° C. and relative humidity of 50%. The amount of the inorganic fine particles added to the coating layer is preferably 0.5 to 70%, more preferably 1 to 60%, by weight of the total weight of the coating layer.

When the amount is less than 0.5% by weight, the effect thereof is insufficient and when the amount is more than 70% by weight, the coating layer tend to difficult to form and lowering in the durability is caused by peeling off of the layer.

<Preparation method of carrier>

Although the coating layer formed by an immersing coating method, spray coating method or fluidized coating method is effective sufficiently, a method of dry coating by mechanical impact is particularly preferred. The inorganic fine particles are uniformly dispersed in the resin by the dry coating method. The coating layer formed by the dry coating is strongly adhered to the core particle because the resin in a form of fine particles are pressed and adhered to the surface of the core particle by the mechanical impact. Therefore, the coating layer is excellent in the durability.

In the first step of this method, magnetic core particles of the carrier, the fine organic particles and the particles of the coating resin are stirred and mixed by an ordinary mixing device so as to adhere the fine organic particles and coating resin particles to the surface of the magnetic core particles by a physical adhering force or electrostatic adhering force. The first step may be carried out with or without heating so as to slightly soften the resin particles. Then the second step of the method is performed after completion of the first step. In the second step, the mixture is stirred with a strong force with or without heating for giving mechanical impact to the mixture so as to fix the inorganic particles and the resin particles on the surface of the individual core particle to prepare the coated carrier.

Although various kinds of mixing devices can be used for the first step, a device by which the second step can be performed continued to the first step is preferred.

When the second step is carried out without any heating, the temperature of the mixture is generally raised by 30° to 60° C. by frictional heat generation and the resin particle adhered on the core particles in the first step are softened and fixed easily. When the second step is performed with heating, the temperature is preferably controlled at 60° to 120° C. Excessive heating tends to causes coagulation of the primary particles of the carrier among themselves.

Thus obtained carrier particle has the resin coating layer comprising an alicyclic methacrylate component which has a high resistivity to degradation during a prolonged using term and an acyclic methacrylate component which has an excellent adhering ability with the core particle inhibits peeling off of the resin layer during the prolonged using term. Therefore, the surface of the carrier is adequately worn away and spent toner particle adhered on the surface of the carrier particle is removed. Thus the surface of the carrier particle is maintained to be fresh without any excessive wearing of the carrier particle. Such effect is referred to refreshing effect of the carrier. It is considered that the suitable refreshing effect of the above-mentioned carrier is obtained by a good balancing between the properties of the polymer composed of the alicyclic methacrylate component and the acyclic methacrylate component, the former makes the polymer to easily be worn and the later makes the polymer to hardly be worn.

The developer of the invention composed of the above-mentioned toner and carrier is preferably used under the following conditions.

<Photoreceptor>

A commonly used photoreceptor such as a selenium photoreceptor, amorphous silicon photoreceptor or an organic photoreceptor can be adequately used.

<Developing condition>

The thickness of developer layer formed on the magnetic drum of the developing device is preferably 20 to 500 μm, more preferably 50 to 400 μm.

For regulating the thickness of the developer layer, a regulator made by a ferromagnetic metal such as iron or an iron alloy, having a stiffness of not less than $10^4$ kg/cm$^2$, or that made by a hard resin having a stiffness of $1.0\times10^4$ to $10\times10^4$ kg/cm$^2$ is preferably usable.

The pressure to be given to the developer layer is preferably 1 to 20 gf/mm, more preferably 2 to 10 gf/g.

EXAMPLE

In the examples, the following measuring apparatuses were used for measuring physical properties of the materials to be used in the toner or the carrier.

Volume average diameter of the inorganic fine particle and resin particle: Transmission type electron micrometer LPA-3100 (Otsuka Densi Co., Ltd.)

BET specific area of the inorganic particle and resin particle: Flow Sorb II 2300 (Shimazu Seisaku-sho)

Volume average diameter of carrier particle: Microtlack SRA MK-II (Nikkisou Co., Ltd.)

Glass transition point Tg of resin: Differential calorimeter DSC 7 (Perkin-Elmer Co., Ltd.)

The followings, "parts" means "parts by weight".

<Preparation of colored particles>

A mixture of 100 parts of polyester resin having a Tg of 55.1° C., 10 parts of carbon black and 3 parts of polypropylene was kneaded, crushed and classified to form a black colored particle 1 having a volume average size of 8.5 μm.

Further yellow colored particles 2, magenta colored 3 and cyan colored particles 4 were prepared in the same manner as in colored particles 1 except that the carbon black is replaced by a yellow pigment (C.I. Pigment Yellow 17), a magenta pigment (C.I. Pigment red 122) and a cyan pigment (C.I. Pigment Blue 15:3), respectively.

<Preparation of inorganic fine particles (I)>

Silicon tetrachloride was decomposed by hydrolysis in an oxyhydrogen flame under various conditions of the quantity of water and decomposition temperature for preparing various kinds of fine particles of silica. The size of the particles is further controlled by classification. The silica particles were hydrophobilized by means of hexamethyldisilazane. Thus nine kinds of silica fine particles listed in the following Table 1 were prepared.

TABLE 1

| Sample Name | Volume average particle diameter (μm) | Standard deviation (σ) |
|---|---|---|
| Inorganic Particle A | 0.070 | 25 |
| Inorganic Particle B | 0.035 | 16 |
| Inorganic Particle C | 0.014 | 10 |
| Inorganic Particle D | 0.150 | 23 |
| Comparative Inorganic particle F | 0.250 | 20 |
| Comparative Inorganic particle G | 0.050 | 9 |
| Comparative Inorganic particle H | 0.080 | 35 |

<Preparation of resin fine particle>

Resin fine particles J, K and L of the invention were prepared which are different in the volume average diameter from each other were prepared by condensation polymerization of melamine and formaldehyde under various conditions of temperature and reaction time.

On the other hand a kind of comparative resin particles of polymethyl methacrylate (MMA) prepared by emulsion polymerization having an volume average diameter of 0.100 μm, which was referred to comparative resin particle M. The resin particles are listed in Table 2.

TABLE 2

| Sample Name | Volume average particle diameter (μm) | Composition of monomer | Sphericity |
|---|---|---|---|
| Resin particle J | 0.180 | Melamine-formaldehyde | 0.95 |
| Resin particle K | 0.050 | Melamine-formaldehyde | 0.97 |
| Resin particle L | 0.500 | Melamine-formaldehyde | 0.97 |
| Comparative Resin particle M | 0.100 | MMA | 0.90 |

<Preparation of toner>

Each of the above-mentioned color particles is mixed with the resin fine particles and the inorganic fine particles by a Henshel mixer under the following conditions of the temperature and the circumferential speed at the point of stirrer blade to fix the fine particles on the surface of the colored particle.

| | Temperature | Circumferential speed |
|---|---|---|
| Fixing condition 1: | Tg - 30° C. | 40 m/sec. |
| Fixing condition 2: | Tg - 15° C. | 40 m/sec. |

-continued

| | Temperature | Circumferential speed |
|---|---|---|
| Fixing condition 3: | Tg°C. | 30 m/sec. |
| Fixing condition 4: | Tg + 10° C. | 20 m/sec. |

Thus inventive and comparative samples of toner shown in Table 3 were prepared. The combination of the colored particles, resin fine particles and inorganic fine particles in the toner samples are shown in the following table 3. In Table 3, the amounts of the inorganic and resin particles are described in terms of parts by weight with respect to 100 parts by weight of the colored particles. In the toner No.,k, y, m and c are each represent colore of toner, black, yellow, magentaand cyan, respectively, and T and HT are each represent an inventive and a comparative toner sample, respectively.

TABLE 3

| Tonor | Colored | Inorganic Particle | | Resin particle | | Ratio | Fixing | Fixing |
|---|---|---|---|---|---|---|---|---|
| No. | particle | Kind | Amount (i) | Kind | Amount (r) | (r/i) | Condition | degree |
| T-1k | 1 | A | 2.5 | J | 2.0 | 0.80 | 3 | 85.1 |
| T-2k | 1 | B | 2.5 | J | 1.5 | 0.60 | 2 | 80.6 |
| T-3m | 3 | C | 2.0 | J | 2.5 | 1.25 | 4 | 90.5 |
| T-4y | 2 | D | 3.0 | J | 2.5 | 0.83 | 3 | 80.5 |
| T-5y | 2 | A | 3.0 | K | 1.5 | 2.00 | 3 | 83.5 |
| T-6c | 4 | A | 3.0 | L | 3.0 | 1.00 | 2 | 78.4 |
| T-7m | 3 | A | 4.0 | J | 1.0 | 0.25 | 4 | 80.1 |
| T-8y | 2 | A | 0.5 | J | 1.0 | 2.00 | 1 | 85.1 |
| T-9m | 3 | A | 3.0 | J | 0.8 | 0.27 | 2 | 65.1 |
| T-10c | 4 | A | 3.0 | J | 4.0 | 1.33 | 4 | 93.5 |
| T-11y | 2 | A | 3.0 | J | 3.0 | 1.00 | 4 | 89.1 |
| T-12c | 4 | A | 1.0 | J | 3.0 | 3.00 | 3 | 81.5 |
| HT-1k | 1 | F | 3.0 | J | 2.0 | 0.67 | 4 | 91.4 |
| HT-2c | 4 | G | 3.0 | J | 2.0 | 0.67 | 3 | 82.5 |
| HT-3y | 2 | A | 3.0 | M | 2.0 | 0.67 | 3 | 79.7 |
| HT-4m | 3 | A | 3.0 | J | 0.0 | — | 2 | 63.5 |

<Preparation of carrier>

Cu—Zn ferrite particles having a specific gravity of 5.0, a volume average diameter of 50 μm, and a saturated magnetization of 25 emu/g in an external magnetic field of 1000 Oe. was coated with a resin layer so the layer thickness to be 2.0 μm to prepare carrier particles. Thus samples of carrier shown in Table 4 were prepared. In the samples, the resin and inorganic particle of the coating layer were changed from each other as shown in the following Table 4. In the table, CHMA and MMA are each represent cyclohexyl methacrylate and methyl methacrylate, respectively. The hydrophobicity of each the hydrophilic silica represented by $SiO_2$* was 10, and the particle diameter of the inorganic particle is given in terms of a volume average diameter of primary particles. In the carrier No., C and HC are each represents an inventive and a comparative carrier sample, respectively.

TABLE 4

| Carrier | Coating resin | | Inorganic particle | | | |
|---|---|---|---|---|---|---|
| No. | Kind | Ratio | Kind | Particle diameter (μm) | BET surface area ($m^2/g$) | Added amount (wt-%) |
| C-1 | CHMM/MMA | 5/5 | MgO | 0.01 | 160 | 10 |
| C-2 | CHMM/MMA | 5/5 | $MgCO_3$ | 0.03 | 110 | 10 |
| C-3 | CHMM/NMA | 5/5 | $Mg(OH)_2$ | 0.05 | 80 | 40 |
| C-4 | CHMM/MMA | 5/5 | $SiO_2$* | 0.02 | 190 | 3 |
| C-5 | CHMM/MMA | 5/5 | MgO/$SiO_2$* | 0.07/0.01 | 50/210 | 20/30 |
| C-6 | CHMM/MMA | 2/8 | MgO | 0.1 | 20 | 50 |
| C-7 | CHMM/MMA | 2/8 | MgO/$SiO_2$* | 0.01/0.005 | 160/40 | 30/30 |
| C-8 | CHMM/MMA | 9/1 | MgO | 0.05 | 80 | 10 |
| C-9 | CHMM/MMA | 9/1 | MgO/$SiO_2$* | 0.01/0.02 | 160/190 | 1/5 |
| HC-1 | CHMM/MMA | 5/5 | — | — | — | — |
| HC-2 | MMA/St | 5/5 | — | — | — | — |
| HC-3 | MMA/St | 5/5 | MgO | 0.01 | 160 | 20 |

In the above table, the added amount of the inorganic particles is described in terms of weight % of the particle to the total weight.

<Preparation of developer>

In a V-type mixer, 93 parts by weight of black toner T-1 and 7 parts by weight of carrier C-1 were mixed for 20 minutes under a condition of a temperature of 30° C. and relative humidity of 80% to prepare a black developer D1k. Further, yellow developers D1y, magenta developer D1m and cyan developer D1c were prepared in the same manner as in D1k except that yellow toner T-4y, magenta toner T-6m and cyan toner T-3c were used in place of black toner T-1k, respectively. These four kinds of developer are referred to Developer series 1. In the similar manner, 11 series of developer listed in Table 5 were prepared by the combination of the toner and the carrier shown in the table. In the developer series No. D and HD are each represents a series of inventive and comparative developed.

TABLE 5

| Developer | Toner No. | | | | Carrier |
|---|---|---|---|---|---|
| series No. | Black | Yellow | Magenta | Cyan | No. |
| D-1 | T-1k | T-4y | T-3m | T-6c | C-1 |
| D-2 | T-2k | T-5y | T-7m | T-10c | C-2 |
| D-3 | T-1k | T-8y | T-9m | T-12c | C-3 |
| D-4 | T-2k | T-11y | T-9m | T-12c | C-4 |
| D-5 | T-1k | T-11y | T-7m | T-10c | C-5 |
| D-6 | T-2k | T-4y | T-3m | T-6c | C-6 |
| D-7 | T-1k | T-5y | T-3m | T-6c | C-7 |
| D-8 | T-2k | T-8y | T-9m | T-10c | C-8 |
| D-9 | T-1k | T-11y | T-7m | T-12c | C-9 |
| HD-1 | HT-1k | HT-2y | HT-3m | T-H4c | HC-1 |
| HD-2 | HT-1k | HT-2y | HT-3m | T-H4c | HC-2 |
| HD-3 | HT-1k | HT-2y | HT-3m | T-H4c | HC-3 |

The developers were evaluated in the following manner.

<1>Triboelectric charge under various conditions

First, 19 g of a kind of the carrier was put into a sample vessel with a volume of 20 ml, then 1 g of a kind the toner was put on the carrier in the vessel, and the samples were stand for more than 3 hours under a condition of a temperature of 10° C. and relative humidity of 10% and a condition of a temperature of 33° C. and a relative humidity of 90%.

After standing, the samples were mixed by a shaking machine, Yayoi New-YS, for 60 minutes with shaking angle of 30° and a shaking rate of 200 strokes/min. The triboelectric charge of the toner was measured by a blow-off charge measuring apparatus. Triboelectric charge of the toner was further measured after 10,000 copies. The toner was put out from the developing device after 10,000 copies and was subjected to measure by the blow-off charge measuring apparatus. The measuring was carried out with respect to the blade toner only.

<Evaluation by actual copying machine>

Image forming experiments were performed according to the following image forming methods 1 and 2, in which actual copying operations were carried using the following copy machine under a high temperature and high humidity condition of 33° C. and 10% of relative humidity, and a low temperature and low humidity condition of 10° C. and 10% of relative humidity. In the experiments, the difference in developing ability and image transferring ability at the initial stage of copying caused by the difference of the environment condition, and the situation of toner scattering after operations of 10000 copies. In the experiment according to image forming method 1, a black toner was only used and in the experiments according to image forming method 2, four colored toner having the same number, for example D1k, D1y, D1m and A1c, were used.

In the experiments according to image formation method 2, an anti-spent property or ant abrasion property of the carrier particles was evaluated after operations of 10000 copies. In the image formation method 2, the developer was given a strong stress.

Image formation method 1

Experiments were carried out by the use of a copy machine Konica U-Bix 3035, manufactured by Konica Corporation, which is modified as follows:

(1) Charging process

In the process of charging the photoreceptor of the copying machine, the polarity of discharge electrode was changed from negative to positive so that the electric potential of the photoreceptor at an image portion or a portion of non-exposed to light and the non-image portion or a portion exposed to light were each to be 750 V and 50 V, respectively.

(2) Transferring process

The polarity of discharge electrode for transferring was changed to negative from positive.

(3) Developing process

The bias potential was changed to −150 V.

<Image formation method 2>

Experiments were carried out by the use of a color copy machine Konica 9028, manufactured by Konica Corporation.

Konica 9028 is a polychromatic image forming machine in which development of image is performed by a non-contact reversal developing method. In this developing method, a layer of developer formed on a sleeve of a developing device is made thinner by thin layer forming made from magnetic stainless steel (SUS416) rod, and is transported into a developing zone. In the developing zone, a electrophotographic latent image formed on the photoreceptor is developed without contacting with the developer layer in a vibrating electric field which is generated by an AC bias potential applied to the developing sleeve.

| | |
|---|---|
| Surface potential of photoreceptor | −700 V |
| DC bias | −500 V |
| AC bias (peak to peak) | 2.2 kV |
| Rotating speed of sleeve | 400 rpm |
| Thickness of developer layer | 300 μm |
| Pressure of developer layer thickness regulating rod | 5 gf/mm |
| Diameter of thin layer forming rod | 6 mm |

<Evaluation items>

(1) Developing ability

An image of a standard patch having an optical density of 1.3 and an area of 10 $cm^2$ formed on the photoreceptor was developed and the amount of toner forming the developed image in terms of mg per $cm^2$ was determined. In the experiments according to image formation method 1, the evaluation was performed with respect to a black monochromatic image. In the experiments according to image formation method 2, an image containing yellow, magenta, cyan and black images with a coverage of 5%, respectively, was copied, and the developing ability was evaluated with respect to thus obtained image at the initial time and after 10000 copies.

Numbers of scattered toner particles after 10000 copies was measured by a particle counter set in the copying machine. (3) Anti-abrasion or anti-spent property of coating layer of carrier particle Anti-abrasion property of the coating layer of carrier particles were evaluated by measuring the weight ratio of the coating layer to that of the core particles of the carrier particles after 10000 copies by the following method. The evaluation was carried out with respect to the black developer after 10000 copies used in the image formation method 2. The carrier particles of the developer to be evaluated was separated from the toner particles by washing with water and dried. Thus obtained carrier particles were weighed. Then the coating layer of the carrier particles was removed by methylethyl ketone and the weight of the remaining core particles was measured. The ratio of the weight coating layer was determined by the following equation.

$$\text{Weight ratio of coating layer}=\{(A-B)/B\}\times 100\%$$

A: Weight of carrier particles after drying

B: Weight of carrier particles after remove of coating layer

Further the number of carrier particles each destroyed on the coating layer thereof was determined by the following method.

One thousand particles of the carrier were observed by a scanning electron microscope with a magnitude of 200 times and to count the number of particle of which coating layer was destroyed.

Experimental results thus obtained are listed in the following Tables 6 to 9. In Table 6, dependency of the triboelectric charge of developer on the environmental conditions is shown. In Tables 7 and 8, developing ability and toner scattering in the image formation methods 1 and 2 are listed, respectively. In Table 9, the weight ratio of the coating layer of carrier particles after 10000 copies and the variation thereof during 10000 copies. The ratio of the coating layer at the initial time was 2.00%. Further number of particle destroyed on the coating layer are shown.

TABLE 6

| | Triboelectric charge (μc/g) | | | | |
|---|---|---|---|---|---|
| | 10° C. & 10% RH | | 33° C. & 90% RH | | Absolute difference |
| Developer No. | Initial (1) | Aft. 10000 copies | Initial (h) | Aft. 10000 copies | between (1) & (h) |
| D-1k | 25.4 | 25.3 | 24.9 | 24.8 | 0.5 |
| D-2k | 26.6 | 26.3 | 25.9 | 25.0 | 0.7 |
| D-3k | 27.7 | 27.4 | 26.9 | 25.8 | 0.8 |
| D-4k | 25.6 | 25.1 | 25.4 | 24.6 | 0.2 |
| D-5k | 28.8 | 28.4 | 28.3 | 28.0 | 0.5 |
| D-6k | 28.1 | 27.9 | 28.1 | 27.6 | 0.0 |
| D-7k | 26.0 | 25.7 | 25.7 | 25.1 | 0.3 |
| D-8k | 27.3 | 27.1 | 27.0 | 26.7 | 0.3 |
| D-9k | 27.0 | 27.0 | 27.0 | 26.9 | 0.0 |
| HD-1k | 27.1 | 24.9 | 23.1 | 19.9 | 4.0 |
| HD-2k | 27.9 | 23.2 | 21.7 | 17.9 | 6.2 |
| HD-3k | 28.3 | 24.6 | 23.0 | 19.0 | 5.3 |

TABLE 7

| | Variation in developing ability (mg/cm²) | | | | | |
|---|---|---|---|---|---|---|
| | 10° C. & 10% RH | | 33° C. & 90% RH | | Toner scattering after 10000 copies | |
| Developer No. | Initial | After 10000 copies | Initial | After 10000 copies | 10° C. & 10% RH | 33° C. & 90% RH |
| D-1k | 0.84 | 0.83 | 0.84 | 0.84 | 0 | 0 |
| D-2k | 0.85 | 0.85 | 0.86 | 0.85 | 0 | 0 |
| D-3k | 0.85 | 0.83 | 0.86 | 0.83 | 0 | 0 |
| D-4k | 0.87 | 0.86 | 0.88 | 0.86 | 0 | 0 |
| D-5k | 0.85 | 0.85 | 0.86 | 0.86 | 1 | 0 |
| D-6k | 0.88 | 0.87 | 0.89 | 0.88 | 0 | 0 |
| D-7k | 0.86 | 0.85 | 0.87 | 0.85 | 0 | 0 |
| D-8k | 0.87 | 0.86 | 0.87 | 0.86 | 0 | 0 |

TABLE 7-continued

| | Variation in developing ability (mg/cm²) | | | | | |
|---|---|---|---|---|---|---|
| | 10° C. & 10% RH | | 33° C. & 90% RH | | Toner scattering after 10000 copies | |
| Developer No. | Initial | After 10000 copies | Initial | After 10000 copies | 10° C. & 10% RH | 33° C. & 90% RH |
| D-9k | 0.85 | 0.85 | 0.86 | 0.85 | 0 | 0 |
| HD-1k | 0.85 | 1.03 | 0.85 | 1.16 | 1 | 2 |
| HD-2k | 0.85 | 1.12 | 0.85 | 1.23 | 1 | 5 |
| HD-3k | 0.83 | 1.09 | 0.83 | 1.17 | 1 | 2 |

TABLE 8

| | Variation in developing ability (mg/cm²) | | | | | |
|---|---|---|---|---|---|---|
| | 10° C. & 10% RH | | 33° C. & 90% RH | | Toner scattering after 10000 copies | |
| Developer series No. | Initial | After 10000 copies | Initial | After 10000 copies | 10° C. & 10% RH | 33° C. & 90% RH |
| D-1 | 1.92 | 1.92 | 1.93 | 1.92 | 0 | 0 |
| D-2 | 1.92 | 1.91 | 1.93 | 1.91 | 0 | 0 |
| D-3 | 1.94 | 1.93 | 1.94 | 1.93 | 0 | 0 |
| D-4 | 1.95 | 1.95 | 1.96 | 1.95 | 0 | 0 |
| D-5 | 1.94 | 1.94 | 1.95 | 1.94 | 1 | 0 |
| D-6 | 1.95 | 1.95 | 1.95 | 1.95 | 0 | 0 |
| D-7 | 1.94 | 1.94 | 1.94 | 1.94 | 0 | 0 |
| D-8 | 1.94 | 1.94 | 1.95 | 1.94 | 0 | 0 |
| D-9 | 1.94 | 1.93 | 1.94 | 1.93 | 0 | 0 |
| HD-1 | 1.88 | 2.01 | 2.19 | 2.21 | 1 | 2 |
| HD-2 | 1.89 | 2.03 | 2.09 | 2.33 | 1 | 5 |
| HD-3 | 1.90 | 2.06 | 2.12 | 2.26 | 1 | 2 |

TABLE 9

| | Weight ratio of coating layer | | | Number of |
|---|---|---|---|---|
| Developer No. | Initial | After 10000 copies | difference | destroyed particle |
| D-1k | 2.00 | 1.98 | −0.02 | 1 |
| D-2k | 2.00 | 1.97 | −0.03 | 1 |
| D-3k | 2.00 | 1.98 | −0.02 | 1 |
| D-4k | 2.00 | 1.99 | −0.01 | 1 |
| D-5k | 2.00 | 1.99 | −0.01 | 0 |
| D-6k | 2.00 | 1.99 | −0.03 | 2 |
| D-7k | 2.00 | 1.97 | −0.01 | 0 |
| D-8k | 2.00 | 1.99 | −0.02 | 2 |
| D-9k | 2.00 | 1.98 | −0.02 | 1 |
| HD-1k | 2.00 | 1.89 | −0.11 | 17 |
| HD-2k | 2.00 | 1.56 | −0.44 | 285 |
| HD-3k | 2.00 | 1.67 | −0.33 | 252 |

What is claimed is:

1. A toner for forming an electrophotographic image comprising colored particles comprising a resin and a colorant, fine resin particles comprising a polymer formed by condensation of melamine and formaldehyde, and have a volume average diameter of 0.01 μm to 1.0 μm, and fine particles of an inorganic material (I) having a volume average diameter of 0.01 μm to 0.20 μm and a standard deviation of distribution of the volume average diameter σ satisfying the condition of $10 \leqq \sigma \leqq 30$, said fine particles and said fine particles of an inorganic material (I) are fixed on the surface of said colored particle by mechanical impact.

2. The toner of claim 1, wherein said colored particles has a volume average diameter of 1 to 30 μm.

3. The toner of claim 1, wherein said resin of said colored particles has a glass transition point Tg of 40° to 70° C.

4. The toner of claim 1, wherein the amount of said fine resin particles is within the range of from 0.1 to 5.0% by weight of the total weight of the toner.

5. The toner of claim 1, wherein the amount of said fine particles of an inorganic material (I) is within the range of from 0.1 to 5.0% by weight of the total weight of the toner.

6. The toner of claim 1, wherein said fine particles of an inorganic material (I) has a methanol wettability of 40 to 95.

7. The toner of claim 1, wherein the weight ratio of said fine resin particles to said fine particles of an inorganic material (I) is within the range of from 0.1 to 3.0.

8. The toner of claim 6 wherein said inorganic material (I) is selected from the group consisting of silica, alumina, and magnesia.

9. A developer for developing an electrophotographic image comprising a toner and a carrier, wherein said toner comprises colored particles comprising a resin and a colorant, fine resin particles comprising a polymer formed by condensation of melamine and formaldehyde, and have a volume average diameter of 0.01 μm to 1.0 μm, and fine particles of an inorganic material (I) having a volume average diameter of 0.01 μm to 0.20 μm and a standard deviation of distribution of the volume average diameter $\sigma$ satisfying the condition of $10 \leqq \sigma \leqq 30$, said fine resin particles and said fine particles of an inorganic material (I) are fixed on the surface of said colored particles by mechanical impact, and said carrier is a negatively chargeable carrier comprising magnetic core particles each coated with a coating layer comprising a mixture of homopolymer of an alicyclic methacrylate monomer and a homopolymer of an acyclic methacrylate monomer, or a copolymer of an alicyclic methacrylate monomer and an acyclic methacrylate monomer, and a fine particles of an inorganic material (II).

10. The developer of claim 9, wherein said colored particles has a volume average diameter of 1 to 30 μm.

11. The developer of claim 9, wherein said resin of said colored particles has a glass transition point Tg of 40 to 70° C.

12. The developer of claim 9, wherein the amount of said fine resin particles is within the range of from 0.1 to 5.0% by weight of the total weight of the toner.

13. The developer of claim 9, wherein the amount of said fine particles of an inorganic material (I) is within the range of from 0.1 to 5.0% by weight of the total weight of the toner.

14. The developer of claim 9, wherein said fine particles of an inorganic material (I) has a methanol wettability of 20 to 99.

15. The developer of claim 9, wherein the weight ratio of said fine resin particles to said fine particles of an inorganic material (I) is within the range of from 0.1 to 3.0.

16. The developer of claim 9, wherein said coating layer is formed by fixing particles of said mixture of a homopolymer of an alicyclic methacrylate monomer and a homopolymer of an acyclic methacrylate monomer, or said copolymer of an alicyclic methacrylate monomer and an acyclic methacrylate monomer, and said fine particles of an inorganic material (II) on the surface of said magnetic core particles by mechanical impact.

17. The developer of claim 9, wherein said magnetic core particles have a volume average diameter of 20 to 100 μm.

18. The developer of claim 9, wherein said alicyclic methacrylate monomer is cyclohexyl methacrylate.

19. The developer of claim 9, wherein said acyclic methacrylate monomer is a methacrylate of an acyclic group having 1 to 6 carbon atoms.

20. The developer of claim 9, wherein the amount of said resin of said coating layer is within the range of from 0.5 to 5.5% bye weight of the weight of the magnetic core particle.

21. The developer of claim 9, wherein said fine particles of an inorganic material have a volume average diameter of 1 nm to 200 nm and a BET specific surface area of 10 to 500 $m^2/g$.

22. The developer of claim 21, wherein said fine particles of an inorganic material have a hydrophobicity of not less than 20.

23. The developer of claim 22, wherein said fine particles of an inorganic material comprises hydrophilic colloidal silica.

24. The developer of claim 22, wherein said fine particles of an inorganic material comprises an inorganic magnesium compound.

25. The developer of claim 22, wherein the amount of said fine particles of an organic material in said resin coating layer is within the range of from 0.5 to 70% by weight of the total weight of said coating layer.

* * * * *